US005114147A

United States Patent [19]

Faylo

[11] Patent Number: 5,114,147

[45] Date of Patent: May 19, 1992

[54] APPARATUS AND METHOD OF PLAYING A GAME WITH MULTI-COLORED STICKS

[76] Inventor: John Faylo, 726 Cadwell St., Watertown, N.Y. 13601

[21] Appl. No.: 763,309

[22] Filed: Sep. 20, 1991

[51] Int. Cl.[5] ..... A63F 9/04

[52] U.S. Cl. ..... 273/146

[58] Field of Search ..... 273/146, 138 R

[56] References Cited

U.S. PATENT DOCUMENTS

| | | | |
|---|---|---|---|
| 1,561,592 | 11/1925 | Bott | 273/146 |
| 1,787,521 | 1/1931 | Harrington | 273/146 |
| 2,922,652 | 1/1960 | Stange | 273/146 |
| 4,365,812 | 12/1982 | Martini | 273/146 |
| 4,469,329 | 9/1984 | Guyer | 273/146 |
| 4,648,602 | 3/1987 | Maroney | 273/146 |
| 4,834,386 | 5/1989 | Rosenthal et al. | 273/146 |
| 4,930,780 | 6/1990 | Goodman et al. | 273/146 |

*Primary Examiner*—Benjamin Layno

*Attorney, Agent, or Firm*—Katherine McGuire

[57] ABSTRACT

A game played between two or more players comprises a plurality of elongated sticks of generally square cross-section. Each of the four sides of each stick are of a different color. Some colors occur more frequently than others and are worth fewer points. The less frequently a color appears, the more it is worth. The game is played by tossing the sticks into the air and having them land on a surface. Points are scored according to the assigned values of the respective colors appearing on the upwardly facing sides of the sticks. Each player attempts to outscore his opponent by rolling rare combinations of colors. The player who can roll the rarest combination wins.

9 Claims, 2 Drawing Sheets

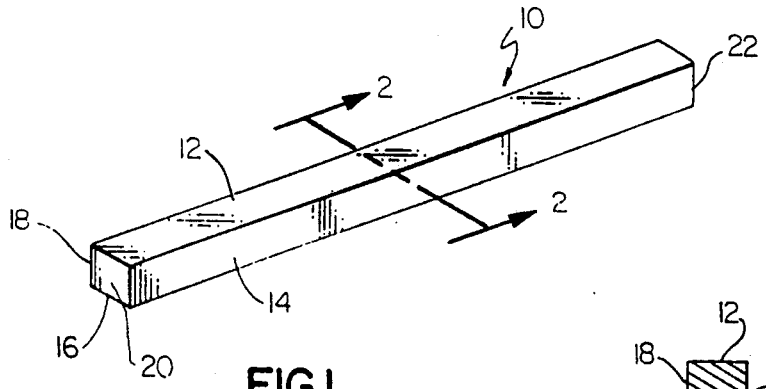
FIG.1
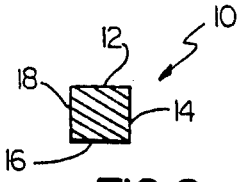
FIG.2
FIG.3a
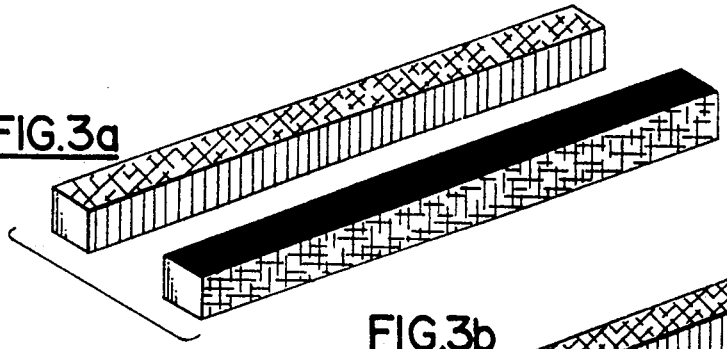
FIG.3b
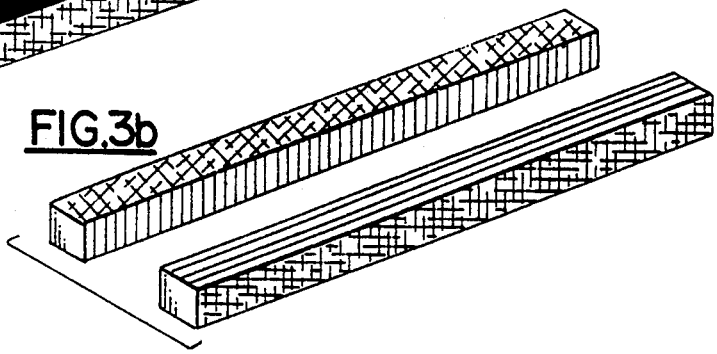
FIG.3c
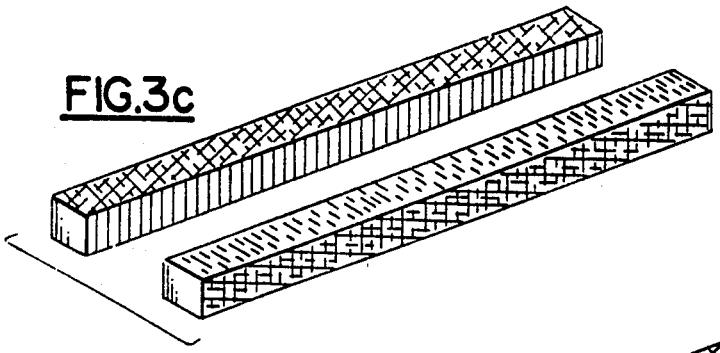
FIG.3d
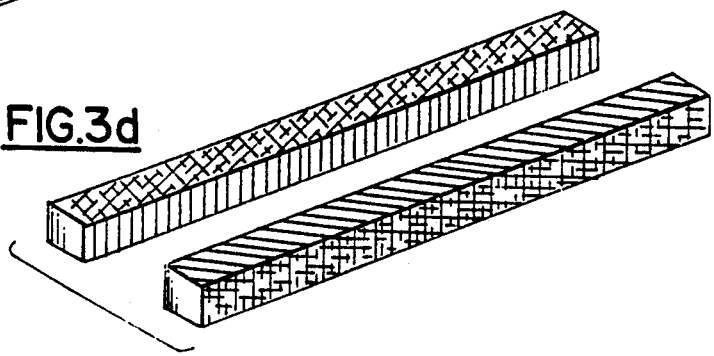

APPARATUS AND METHOD OF PLAYING A GAME WITH MULTI-COLORED STICKS

BACKGROUND OF THE INVENTION

This invention relates to amusement games and, more particularly, to a game for two or more players which employs a plurality of sticks of generally square cross-section which are color coded along each side thereof.

Many games involve the use of elongated sticks in one way or another. For example, U.S. Pat. No. 3,617,057, issued to Goldfarb on Nov. 2, 1971, discloses a game comprising a plurality of sticks of different colors which are gathered and secured together by a ring. Playing cards are drawn having colors which match with correspondingly colored sticks which must be removed from the bunch without disturbing the remaining bunch of sticks.

U.S. Pat. No. 4,365,812, issued to Martini on Dec. 28, 1982, discloses a game comprising a game board with markers which are moved according to the roll of stick dice which have alternating colored sides. The colors rolled, i.e., the colors on the uppermost sides of the thrown sticks, indicate to the players where their markers on the board are to be moved. In a like manner, U.S. Pat. No. 1,878,521, issued to Harrington, Jr. on Jan. 6, 1931, discloses a game comprising a game board with markers positioned thereon which are to be removed in accordance with the rolling of indicator sticks. Each stick has six lateral faces of different primary colors. The combinations of primary colors rolled constitute a secondary color which matches with a marker which then may be removed from the player's board. The first player to remove all his/her markers from their board wins the game.

From the foregoing, it may be realized that although the idea of a game using multi-colored sticks is not per se new, many different games may be invented which employ the use of colored sticks.

SUMMARY OF THE INVENTION

It is therefore a principal object of the present invention to provide a game apparatus for two or more players comprising a plurality of multi-colored sticks which are tossed by each player who then is awarded points in accordance with the respective values of the colors appearing on the upward facing surfaces of the sticks.

It is another object of the present invention to provide a method playing a game which is played in accordance with a novel and challenging scoring scheme which makes the game very interesting and fun to play.

It is a further object of the present invention to provide such a game which requires thoughtful strategy throughout the play of the game as well as luck of the toss.

It is yet another object of the present invention to provide a game which uses apparatus which is cheap to manufacture, requires very little packaging and is otherwise economically attractive.

Other objects will in part be obvious and in part appear hereinafter.

In accordance with the foregoing objects, the invention comprises a game played with seven multi-colored sticks. Each stick is of square cross-section and is of a different color on each of its four sides. Seven different colors appear on the sticks in different frequencies. For example, the color red appears seven times while the color black only appears once. Furthermore, none of the seven sticks are exactly the same four colors.

A different number value is allotted to each of the seven colors. The more frequent a color appears, the less it is worth. For example, since the color red is found on seven different sides of the seven sticks (on one side of each stick), it is worth only one point. On the other hand, the color black only appears once (on one side of one of the seven sticks) and is therefore worth seven points. Five other colors respectively appear between two and six times, inclusive, and are valued between six and two points, respectively.

The rules of the game involve the players each taking turns at throwing all the sticks up in the air and letting them fall upon a surface. The sides of the sticks facing upwardly are counted according to their color. The total value is compared to the opponent's total value with specific rules of play to be described in detail below.

BRIEF DESCRIPTION OF THE DRAWINGS

FIG. 1 is a perspective view of one of the seven playing sticks of the invention;

FIG. 2 is an elevational, cross-sectional view of the stick as taken generally along the line 2—2 in FIG. 1;

FIG. 3*a* is a composite, perspective view of a first one of the seven playing sticks showing the colors yellow, red, black and orange on the four sides thereof;

FIG. 3*b* is a composite, perspective view of a second one of the seven playing sticks showing the colors yellow, red, blue and orange on the four sides thereof;

FIG. 3*c* is a composite, perspective view of a third one of the seven playing sticks showing the colors yellow, red, violet and orange on the four sides thereof;

FIG. 3*d* is a composite, perspective view of a fourth one of the seven playing sticks showing the colors yellow, red, green and orange on the four sides thereof;

DETAILED DESCRIPTION

Figure 3E:
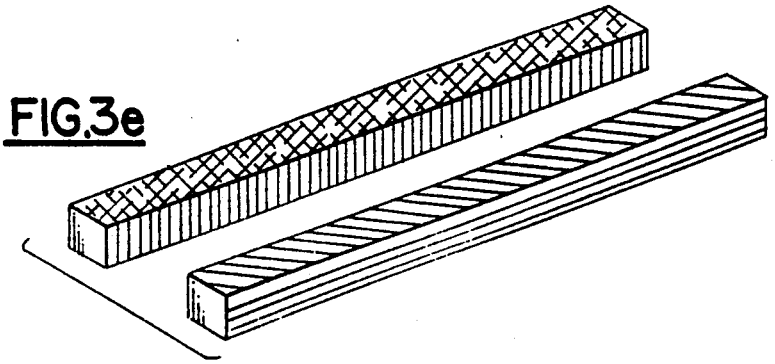
FIG. 3*e* is a composite, perspective view of a fifth one of the seven playing sticks showing the colors orange, red, green and glue on the four sides thereof.
Figure 3F:
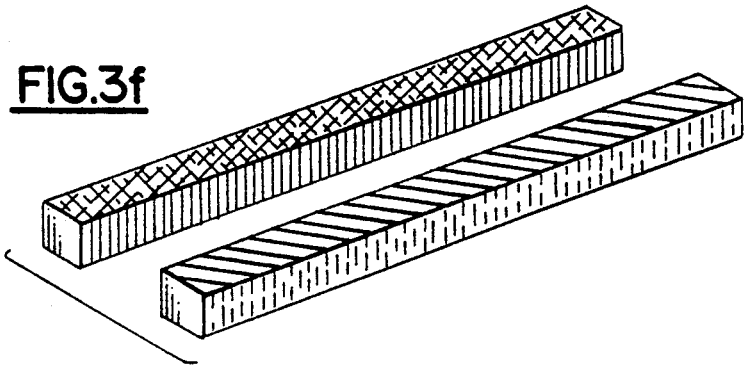
FIG. 3*f* is a composite, perspective view of a sixth one of the seven playing sticks showing the colors orange, red, green and violet on the four sides thereof.
Figure 3G:
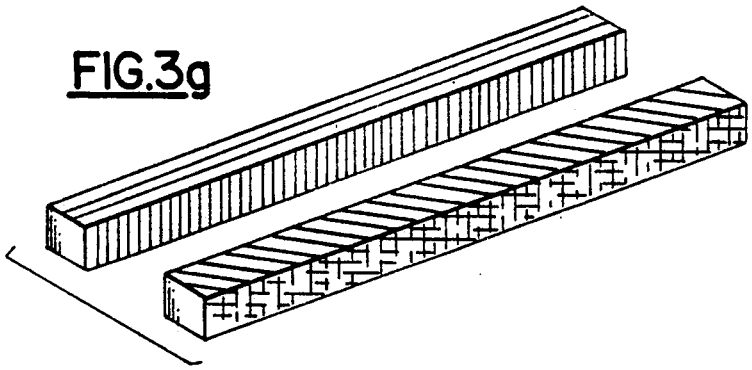
FIG. 3*g* is a composite, perspective view of a seventh one of the seven playing sticks showing the colors blue, red, green and yellow on the four sides thereof.

Referring to the drawings, a representative game stick 10 is seen of generally square cross-section having four sides 12, 14, 16 and 18 with opposite ends 20 and 22. A total of seven game sticks 10 are required to play the game. Each side 12, 14, 16 and 18 of a stick 10 is a different color. There are a total of seven different colors used on the sticks with each stick having four different colors and no stick having all the same colors as another stick. The color codes for each of the seven sticks are as follows:

| Stick | Side 1 | Side 2 | Side 3 | Side 4 |
|---|---|---|---|---|
| 1 | Red | Orange | Black | Yellow |
| 2 | Red | Orange | Blue | Yellow |
| 3 | Red | Orange | Violet | Yellow |
| 4 | Red | Orange | Green | Yellow |
| 5 | Red | Orange | Green | Blue |
| 6 | Red | Orange | Green | Violet |

-continued

| Stick | Side 1 | Side 2 | Side 3 | Side 4 |
|---|---|---|---|---|
| 7 | Red | Blue | Green | Yellow |

It will thus be noticed that each of the seven colors occur with a different frequency. The more frequently the color occurs, the less it is worth. The occurrence and corresponding value of each color are:

| Color | Frequency | Value |
|---|---|---|
| Red | 7 | 1 |
| Orange | 6 | 2 |
| Yellow | 5 | 3 |
| Green | 4 | 4 |
| Blue | 3 | 5 |
| Violet | 2 | 6 |
| Black | 1 | 7 |

The method and rules of play will now be discussed in detail. The game is played in matches with seven individual games equaling one match. Each match is won on points; the player with the LEAST amount of points at the end of the match is declared the winner. Each game is won on score; the player who made the highest roll in the game is declared the winner. For ease of illustration, the game will be described for play by two players although more than two players may play in the manner to be described hereafter. To determine which player will begin the game, each player takes a turn picking up the seven sticks and tossing them in the air. The sticks may land on any surface available and may come to rest at any angle. Sticks that land on an end 20 or 22 must be picked up and tossed again. The sides of the sticks facing upwardly are counted in accordance with their corresponding point value.

The player with the highest roll goes first by tossing all the sticks again. The points are counted in accordance with the colors facing upwardly which is the opening score. For example, if the upwardly facing sides of the seven sticks are three red, two orange, one blue and one black, the total score for that toss would be $(1+1+1)+(2+2)+(5)+(7)=19$ where each set of parentheses indicate the values for the colors red, orange, blue and black, respectively. The score of 19 is thus the opening score for the first game. The sticks are now passed to the opponent. The opponent has a maximum of three rolls to beat the opening score.

After making his first roll, a player may opt to roll all the sticks again or keep any sticks of his choice and reroll the rest. If he keeps any sticks he forfeits his third roll. If a player rerolled all the sticks he may opt to keep up to two sticks from his second roll and reroll the rest a final time at no penalty.

When a player generates a score that exceeds the highest score rolled to that point, he may volley the sticks to his opponent. His opponent then has a maximum of three rolls to beat the new highest score. Volleying continues until one player fails to beat the highest score within his allotted rolls. The game is over and the winner gains control of the sticks. The loser gains points equal to the difference between the losing roll and the highest score rolled.

STANDING— A player has the option of standing on any roll even if he forfeits the game by doing so. He is never required to roll the sticks. (Example: Player 1 rolls 31 and volleys. Player 2 rolls 33. Player 1 stands on 31 thus forfeiting the game and receiving two points rather than rolling and possibly getting a score lower than 31.) Additionally, a player is never required to volley when he beats the highest score. He may complete his remaining rolls, hoping to improve his score, until he runs out of eligible rolls (at which point he must volley). Note that if he rerolls and gets a lower score than the highest score, he still loses the game.

TIES— If a player matches the highest score and runs out of rolls or chooses to stand, no further volleys take place. A tie breaker is executed instead. Each player is allowed one toss of the sticks and the higher roll wins. Points gained are the difference between the two rolls. If a tie persists after the first tie break roll a second roll (or more if necessary) is made. Points gained on the second roll are doubled, on the third roll tripled, etc.

After all seven games have been played each player adds his score. The player with the lower score wins. A score of zero is considered perfect and the losing player must double his final score for that match.

OPTIONAL RULES

Color Run

In addition to the normal scoring described above, rolls may be scored on the basis of large numbers of the same color appearing on a roll. A player may choose to score his roll on color run instead of value addition. Any sticks not part of the color run are ignored. Color run may be designated at any time.

| | |
|---|---|
| Four of any color | 25 pts. |
| Five of any color | 29 pts. |
| One of each color | 32 pts. |
| Six of any color | 34 pts. |
| Seven of any color | 38 pts. |

Grand Play

Grand Play is an extended series of seven matches of standard play. Low score at the end of seven matches wins. Players calculate match victories normally but also keep a record of the running score for each player. This is done by totaling the points gained in each of the 49 games by that player (7 games $\times$ 7 matches $=49$ games). From this score the player may subtract one for each match he won. Both players then compare scores to determine the winner. It is possible for a player to win a majority of the matches and still lose the Grand Play.

Multi-Player

Use the following rule changes for multiple players: Volleys travel counterclockwise. If a player fails to beat the highest score he gains points normally and is out of that game. The next player must still beat the highest score. This continues until there is only one player left. He is the winner and gains control of the sticks. There are no tie breakers: matching the highest score allows you to volley. If you start your turn tied with the present highest score, you must try to beat it.

What is claimed is:

1. A game apparatus comprising a total of n elongated sticks of substantially square cross-section, each of said sticks having four, laterally adjacent sides, each of said sides being of a different color selected from a predetermined set of n colors, one of said colors appearing on said sticks a total of n times and each of the other said colors appearing on said sticks in descending frequency a total of [n−1, n−2, . . . , n−(n−1)] times with each of said sticks having a unique set of four of said colors.

2. The invention according to claim 1 wherein n equals seven.

3. The invention according to claim 2 wherein said colors and respective frequencies of appearance comprise:

| Color | Frequency |
|---|---|
| Red | 7 |
| Orange | 6 |
| Yellow | 5 |
| Green | 4 |
| Blue | 3 |
| Violet | 2 |
| Black | 1 |

4. The invention according to claim 3 wherein the four sides of each of said seven sticks comprise the colors:

| STICK | SIDE 1 | SIDE 2 | SIDE 3 | SIDE 4 |
|---|---|---|---|---|
| 1 | Red | Orange | Black | Yellow |
| 2 | Red | Orange | Blue | Yellow |
| 3 | Red | Orange | Violet | Yellow |
| 4 | Red | Orange | Green | Yellow |
| 5 | Red | Orange | Green | Blue |
| 6 | Red | Orange | Green | Violet |
| 7 | Red | Blue | Green | Yellow |

5. A method of playing a game between at least two players with a total of n elongated sticks of substantially square cross-section, each of said sticks having four sides with each of said sides of a different color totaling a set of n colors, each said color representing a respective, predetermined number, said method comprising the steps of:

a) determining which player will go first by any random chance method;

b) said first player picking up and tossing said sticks at least once to land and come to rest upon a surface;

c) determining said first player's score by adding said respective, predetermined numbers on each tossed stick in accordance with the color on the upwardly facing sides of said tossed sticks;

d) continuing play by a second of said at least two players picking up and tossing said sticks at least once;

e) determining said second player's score by adding said respective, predetermined numbers on each tossed stick in accordance with the color on the upwardly facing sides of said tossed sticks; and f) continuing alternating tossing of said sticks between said first and second players in accordance with steps 5 b) through e) until one of said players fails to obtain a score higher than the other of said players' score whereby the highest score determines the winner of the game and the loser of the game receives points equal to the difference between said first player's score and said second player's score.

6. The invention according to claim 5 and further comprising the steps of:

g) continuing play by repeating steps 5 b) through f) a total of seven times to equal one match; and h) comparing the total number of said points each said first player and said second player received in accordance with step 5 f) whereby the player with the lowest of said points is declared the winner of said match.

7. A method of playing a game between at least two players with a total of n elongated sticks of substantially square cross-section, each of said sticks having four sides with each of said sides of a different color totaling a set of n colors, each said color representing a respective, predetermined number, said method comprising the steps of:

a) determining which player will go first by any random chance method;

b) said first player picking up and tossing said sticks at least once to land and come to rest upon a surface;

c) determining said first player's score by adding said respective, predetermined numbers on each tossed stick in accordance with the color on the upwardly facing sides of said tossed sticks;

d) continuing play by a second of said at least two players picking up and tossing said stocks at least once;

e) determining said second player's score by adding said respective, predetermined numbers on each tossed stick in accordance with the color on the upwardly facing sides of said tossed sticks; and f) continuing alternating tossing of said sticks between said first and second players until one of said first and second players refuses to toss again whereby said one player loses the game and receives points equal to the difference between the score of said one player's last toss and the score of the other player's last toss.

8. The invention according to claim 7 and further comprising the steps of:

g) continuing play by repeating steps 5 b) through f) a total of seven times to equal one match; and h) comparing the total number of said points each said first player and said second player received in accordance with step 5 f) whereby the player with the lowest of said points is declared the winner of said match.

9. A method of playing a game between at least two players with a total of n elongated sticks having four, laterally adjacent sides each of a color selected from a total of n colors with a first of said colors appearing a total of n times and each of the other said colors appearing on said sticks a total of [n−1, n−2, . . . , (n−(n−1)] times in descending frequency with no one of said sticks having exactly the same set of colors as any other said stick, said method comprising:

a) determining which player will go first by any random chance method;

b) said first player tossing said sticks at least once to land and come to rest upon a surface;

c) determining said first player's score by awarding N points for X sticks having upwardly facing sides of the same color;

d) continuing play by a second player tossing said sticks at least once;

e) determining said second player's score by awarding N points for X sticks having upwardly facing sides of the same color; and f) continuing alternating tossing of said sticks between said first and second players in accordance with steps 5 b) through e) until one of said players fails to obtain a score higher than the other of said players' score whereby the highest score determines the winner of the game and the loser of the game receives points equal to the difference between said first player's score and said second player's score.

* * * * *